US007737927B2

(12) United States Patent
Kwon

(10) Patent No.: US 7,737,927 B2
(45) Date of Patent: Jun. 15, 2010

(54) ORGANIC LIGHT EMITTING DISPLAY DEVICE AND DRIVING METHOD

(75) Inventor: Oh Kyong Kwon, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 660 days.

(21) Appl. No.: 11/678,017

(22) Filed: Feb. 22, 2007

(65) Prior Publication Data

US 2007/0200793 A1 Aug. 30, 2007

(30) Foreign Application Priority Data

Feb. 28, 2006 (KR) ..... 10-2006-0019355

(51) Int. Cl.
*G09G 3/32* (2006.01)

(52) U.S. Cl. ..... 345/82; 345/204

(58) Field of Classification Search ..... 345/82, 345/204

See application file for complete search history.

(56) References Cited

U.S. PATENT DOCUMENTS

2001/0026251 A1* 10/2001 Hunter et al. ..... 345/55
2004/0100427 A1* 5/2004 Miyazawa ..... 345/76
2004/0196239 A1* 10/2004 Kwon ..... 345/92
2005/0007357 A1* 1/2005 Yamashita et al. ..... 345/204
2005/0265071 A1* 12/2005 Kwon ..... 365/154

FOREIGN PATENT DOCUMENTS

KR 10-2005-0035550 4/2005

OTHER PUBLICATIONS

Korean Patent Abstracts, Publication No. 1020050035550 A, Published on Apr. 19, 2005, in the name of Chien et al.

* cited by examiner

*Primary Examiner*—Richard Hjerpe
*Assistant Examiner*—Andrew Schnirel
(74) *Attorney, Agent, or Firm*—Christie, Parker & Hale, LLP

(57) ABSTRACT

A pixel including an organic light emitting diode, an organic light emitting display device including the pixel, and a method for driving the organic light emitting display device. The pixel includes first and second drivers and first and second selectors. A horizontal period for driving the pixel includes first and second periods. The first driver charges a first voltage corresponding to a reference current flowing into a data line during the first period. The second driver charges a second voltage corresponding to a sum of the reference current and a pixel current during the second period. The first selector is turned-on during the horizontal period for connecting the data line to the first and second drivers. The second selector controls the flow of current to the organic light emitting diode and is turned-off during the horizontal period but is otherwise turned-on.

27 Claims, 4 Drawing Sheets

540

640

ORGANIC LIGHT EMITTING DISPLAY DEVICE AND DRIVING METHOD

CROSS-REFERENCE TO RELATED APPLICATIONS

This application claims priority to and the benefit of Korean Patent Application No. 10-2006-0019355, filed on Feb. 28, 2006, in the Korean Intellectual Property Office, the entire content of which is incorporated herein by reference.

BACKGROUND

1. Field of the Invention

The present invention relates to a pixel, an organic light emitting display device, and a method for driving an organic light emitting display device using the pixel, and more particularly to a pixel, an organic light emitting display device, and a method for driving an organic light emitting display device using the pixel, using an electric current.

2. Discussion of Related Art

Organic light emitting display devices are a type of flat panel display device that make use of organic light emitting diodes that emit light by re-combination of electrons and holes. The organic light emitting display device has advantages of high response speed and small power consumption.

FIG. 1 is a block diagram of a conventional light emitting display device. With reference to FIG. 1, the conventional light emitting display device includes a display region 30, a scan driver 10, a data driver 20, and a timing controller 50. The display region 30 includes a plurality of pixels 40 formed at crossings of scan lines S1 to Sn and emission control lines E1 to En with data lines D1 to Dm. The scan driver 10 drives the scan lines S1 to Sn. The data driver 20 drives the data lines D1 to Dm. The timing controller 50 controls the scan driver 10 and the data driver 20.

The timing controller 50 generates a data drive control signal DCS and a scan drive control signal SCS according to externally supplied synchronous signals. The data drive control signal DCS generated by the timing controller 50 is provided to the data driver 20, and the scan drive control signal SCS is provided to the scan driver 10. Furthermore, the timing controller 50 provides externally supplied data Data to the data driver 20.

The scan driver 10 generates a scan signal in response to a scan drive control signal SCS from the timing controller 50, and sequentially provides the generated scan signal to the scan lines S1 to Sn. The scan driver 10 generates an emission control signal in response to the scan drive control signal SCS from the timing controller 50, and sequentially provides the generated emission control signal to the emission control lines E1 to En.

The data driver 20 receives the data drive control signal DCS from the timing controller 50. Upon the receipt of the data drive control signal DCS, the data driver 20 generates data signals, and provides the generated data signals to the data lines D1 to Dm. Here, the data driver 20 provides the generated data signal to the data lines D1 to Dm every 1 horizontal period.

The display region 30 receives power from a first power supply ELVDD and a second power supply ELVSS both located outside the display device, and provides them to the pixels 40. Upon the receipt of power from the first power supply ELVDD and the second power supply ELVSS, the pixels 40 control the amount of a current flowing into the second power supply ELVSS from the first power supply ELVDD through a light emitting element corresponding to the data signal, thus generating light corresponding to the data signal.

Namely, in the conventional light emitting display device, each of the pixels 40 generates light of predetermined luminance corresponding to a data signal to display an image. However, the conventional light emitting display device may have difficulty displaying an image of a desired luminance due to variation in electron mobility and non-uniformity between threshold voltages of transistors included in each of the pixels 40. To solve the aforementioned problem, the data signal may be supplied as an electric current. In practice, when the data signal is supplied as an electric current, a uniform image can be displayed at the display region 30 irrespective of variation between the transistors used in each of the pixels.

However, since the electric current supplied as the data current is small, it takes a long time to deliver a charge equivalent to the data signal. For example, assuming that a capacitive load of a data line is 30 pF, it takes several ms to charge the data line by means of a data signal current that may vary from several tens to several hundreds of nA. If considering 1 horizontal period 1H of several tens of μs, the charging time of several ms is not an insignificant length of time.

SUMMARY OF THE INVENTION

Accordingly, it is an aspect of the present invention to provide a pixel, an organic light emitting display device, and a method for driving an organic light emitting display device using the pixel, which may display an image of uniform luminance.

Embodiments of the present invention provide a pixel including an organic light emitting diode, a first driver charging a data line with a first voltage corresponding to a reference current flowing into the data line during a first period of a horizontal period, a second driver charging the pixel with a second voltage corresponding to a pixel current corresponding to a sum of the reference current and the pixel current during a second period of the horizontal period, a first selector turned-on during the horizontal period for connecting the data line to the first and second drivers, and a second selector disposed between the organic light emitting diode and the second driver and being turned-off during the horizontal period and being turned-off during a period other than the horizontal period.

In one embodiment, the first driver includes a first transistor coupled between a first power supply and the first selector, a second transistor coupled between a second electrode and a gate electrode of the first transistor, and being turned-on during the first period diode-connecting the first transistor, and a first capacitor coupled between the gate electrode and a first electrode of the first transistor, and being charged with a voltage corresponding the reference current flowing into the first transistor during the first period. In one embodiment, the second driver includes a third transistor coupled between the first power supply and the second selector, a fourth transistor coupled between a gate electrode and a second electrode of the third transistor and being turned-on during the second period for diode-connecting the third transistor, a second capacitor coupled to the gate electrode and a first electrode of the third transistor and being charged with a voltage corresponding to the pixel current flowing through the third transistor during the second period, and a fifth transistor coupled between the third transistor and the first selector, and being turned-on during the second period for connecting the third transistor and the data line to each other.

According to a second aspect of the present invention, there is provided an organic light emitting display device including a plurality of pixels coupled with first scan lines, second scan lines, third scan lines, emission control lines, and data lines, a scan driver for driving the first scan lines, the second scan lines, the third scan lines, and the emission control lines, and a data driver for causing a reference current to flow in the data lines during a first period of a horizontal period, and causing a sum of the reference current and a pixel current during a second period of the horizontal period, the pixel current being an electric current flowing in the pixels to an organic light emitting diode that may be included in the pixel for generating light.

In one embodiment, the data driver sinks an electric current from the pixels during the horizontal period when each of transistors included in the pixels are PMOS transistors. In one embodiment, the data driver supplies an electric current to the pixels during the horizontal period when transistors included in the pixels are NMOS transistors. In one embodiment, each of the pixels includes an organic light emitting diode, a first driver charging a voltage corresponding to the reference current during the first period in response to the second scan signal, a second driver charging a voltage corresponding to the pixel current during the second period in response to the third scan signal, a first selector coupling the first and second drivers with the data line during the horizontal period in response to the first scan signal, and a second selector disposed between the organic light emitting diode and the second driver, for electrically isolating the organic light emitting diode and the second driver from each other when the emission control signal is supplied to the second selector, but electrically connecting the organic light emitting diode and the second driver to each other when the emission control is not supplied to the second selector.

According to a third aspect of the present invention, there is provided a method for driving an organic light emitting display device including controlling a reference current to flow into data lines during a first period of a horizontal period, charging a voltage corresponding to the reference current in a first driver included in pixels during the first period of the horizontal period, controlling a sum of the reference current and a pixel current to flow into the data lines during a second period of the horizontal period, charging a voltage corresponding to the pixel current in a second driver included in pixels during the second period of the horizontal period, and supplying the pixel current to an organic light emitting diode from the second driver during a horizontal period following the horizontal period whose operation is described above.

In one embodiment, the reference current is set to be greater than the pixel current. In one embodiment, the pixel current is produced corresponding to a bit value or digital value of the data and the pixel current is the current which actually flows in the pixel.

One embodiment provides an organic light emitting display pixel that is driven during a horizontal period having a first period and a second period. The organic light emitting display pixel includes an organic light emitting diode, first and second drivers, and first and second selectors. The first driver is used for developing a reference current flowing into a data line coupled to the organic light emitting display pixel. The reference current is used for charging the data line with a first voltage during the first period. The second driver is used for developing a pixel current. A sum of the reference current and the pixel current are used for charging the data line with a second voltage during the second period. The first selector is coupled between the data line and the first driver and between the data line and the second driver. The first selector is turned-on during the horizontal period for electrically connecting the data line to the first driver and the second driver. The second selector is coupled between the organic light emitting diode and the second driver. The second selector is turned-off during the horizontal period and is otherwise turned-on. The second selector is used for electrically connecting the second driver to the organic light emitting diode.

One embodiment provides a method for driving an organic light emitting display device. The organic light emitting display device includes data lines and a plurality of pixels. Each of the plurality of pixels include a first driver, a second driver and an organic light emitting diode. Each of the plurality of the pixel are coupled to a data line. The method includes controlling a reference current to flow into the data lines during a first period of a first horizontal period, charging the first driver during the first period of the first horizontal period with a voltage corresponding to the reference current, controlling a sum of the reference current and a pixel current to flow into the data lines during a second period of the first horizontal period, charging the second driver during the second period of the first horizontal period with a voltage corresponding to the pixel current; and supplying the pixel current to the organic light emitting diode from the second driver during a horizontal period following the first horizontal period to cause the organic light emitting diode to emit light.

DETAILED DESCRIPTION

Figure 1:
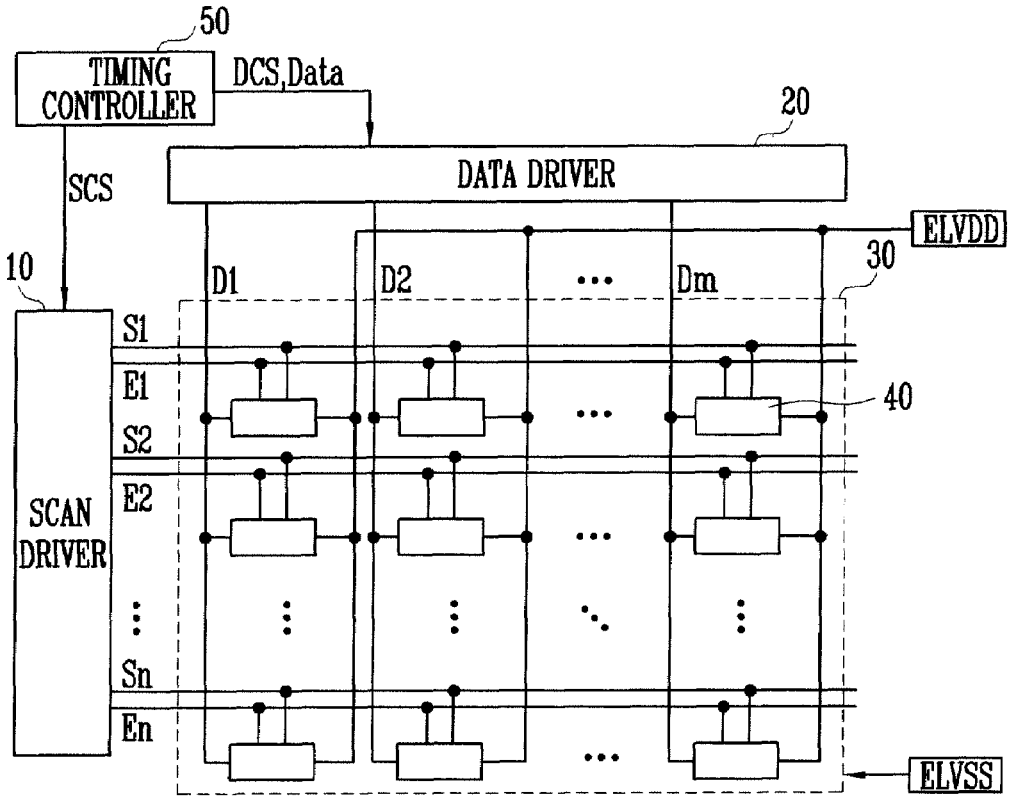
FIG. 1 (PRIOR ART)
FIG. 1 shows a conventional organic light emitting display device.
Figure 2:
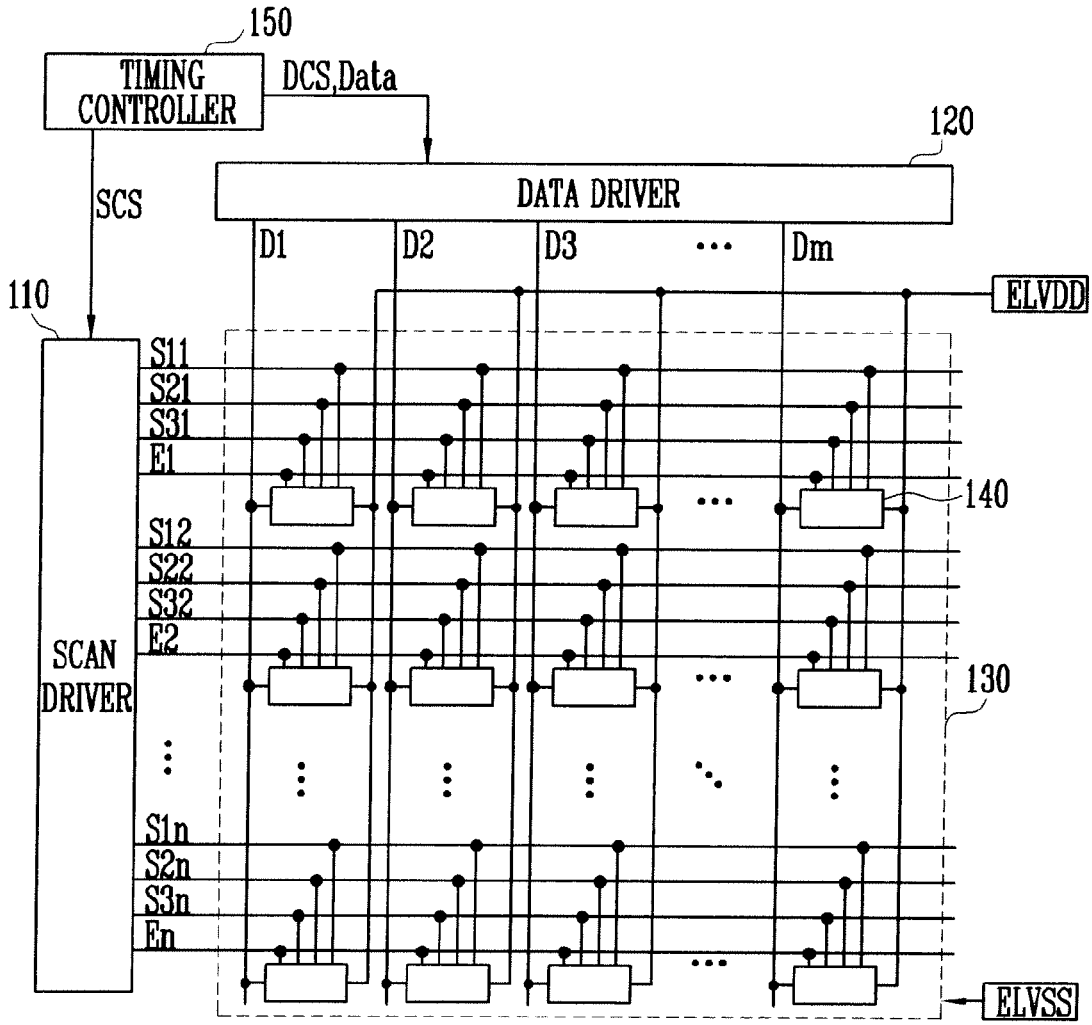
FIG. 2 shows an organic light emitting display device according to an embodiment of the present invention.
Figure 3:
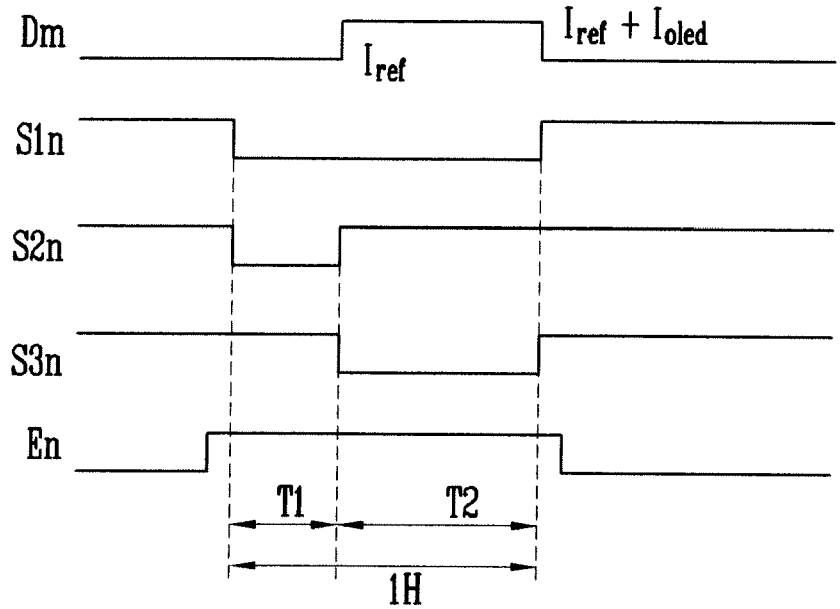
FIG. 3 shows exemplary signals generated by a scan driver and a data driver of the organic light emitting display device of FIG. 2.

Referring to FIGS. 2 and 3, the organic light emitting display device of the present invention includes a display region 130, a scan driver 110, a data driver 120, and a timing controller 150. The display region 130 includes a plurality of pixels 140, which are coupled with first scan lines S11 to S1n, second scan lines S21 to S2n, third scan lines S31 to S3n, emission control lines E1 to En, and data lines D1 to Dm. The scan driver 110 drives the first scan lines S11 to S1n, the second scan lines S21 to S2n, the third scan lines S31 to S3n, and the emission control lines E1 to En. The data driver 120 drives the data lines D1 to Dm. The timing controller 150 controls the scan driver 110 and the data driver 120.

The timing controller 150 generates a data drive control signal DCS and a scan drive control signal SCS according to externally supplied synchronous signals. The data drive control signal DCS generated by the timing controller 150 is provided to the data driver 120, and the scan drive control signal SCS is provided to the scan driver 110. Furthermore, the timing controller 50 provides externally supplied data Data to the data driver 120.

The scan driver 110 generates a scan signal in response to a scan drive control signal SCS from the timing controller 150, and provides the generated scan signal to the first scan lines S11 to S1n, the second scan lines S21 to S2n, and the third scan lines S31 to S3n. The scan driver 110 provides an emission control signal to the emission control lines E1 to En.

With reference to FIG. 3, the scan driver 110 sequentially provides a first scan signal to the first scan lines S11 to S1n. The first scan signal is supplied during one horizontal period 1H. Further, the scan driver 110 sequentially provides a second scan signal to the second scan lines S21 to S2n. The second scan signal is supplied during a first period T1 which is a part of the one horizontal period 1H. Furthermore, the scan driver 110 sequentially provides a third scan signal to the third scan lines S31 to S3n. The third scan signal is supplied during a second period T2 which is also a part of the one horizontal period 1H. The first and second periods T1 and T2 may be mutually exclusive and together add up to the one horizontal period 1H. Moreover, the scan driver 110 sequentially provides an emission control signal to the emission control lines E1 to En. Width or duration of the emission control signal may be equal to or greater than the duration of the first scan signal.

The data driver 120 receives the data drive control signal DCS from the timing controller 150, and generates a data signal in the form of an electric current corresponding to the data signal, and controls the generated electric current to flow in the data lines D1 to Dm.

In detail, the data driver 120 controls a reference current Iref to flow in the data lines D1 to Dm during the first period T1 of a horizontal period. The reference current Iref has a relatively large current value so that a capacitive load of the data lines D1 to Dm may be rapidly charged. Further, the reference current Iref has a fixed value irrespective of the data Data. The value of the data Data is reflected in the data signal generated by the data driver 120.

The data driver 120 supplies the reference current Iref during the first period T1, controls a sum of the reference current Iref and a pixel current Ioled to flow in the data lines D1 to Dm. The pixel current Ioled is an electric current supplied to an organic light emitting diode included in each of the pixels 140, and changes according to the data Data. Value of the pixel current Ioled may be set to less than the reference current Iref.

On the other hand, the data driver 120 controls the direction of the electric current according to the conductivity type of transistors included in the pixels 140. For example, when the transistors included in the pixels 140 are PMOS transistors, the data driver 120 receives the reference and pixel currents Iref and Ioled from the pixels 140. In contrast, when the transistors included in the pixels 140 are NMOS transistors, the data driver 120 provides the reference and pixel currents Iref and Ioled to the pixels 140. Hereinafter, for convenience of description, it is assumed that PMOS transistors are included in each of pixels 140.

The display region 130 receives power from a first power supply ELVDD and a second power supply ELVSS located outside the display device, and provides power to the pixels 140. Upon receiving power from the first power supply ELVDD and the second power supply ELVSS, the pixels 140 provide an electric current corresponding to the pixel current Ioled through the data lines D to the organic light emitting diodes to display a corresponding image.

Figure 4:
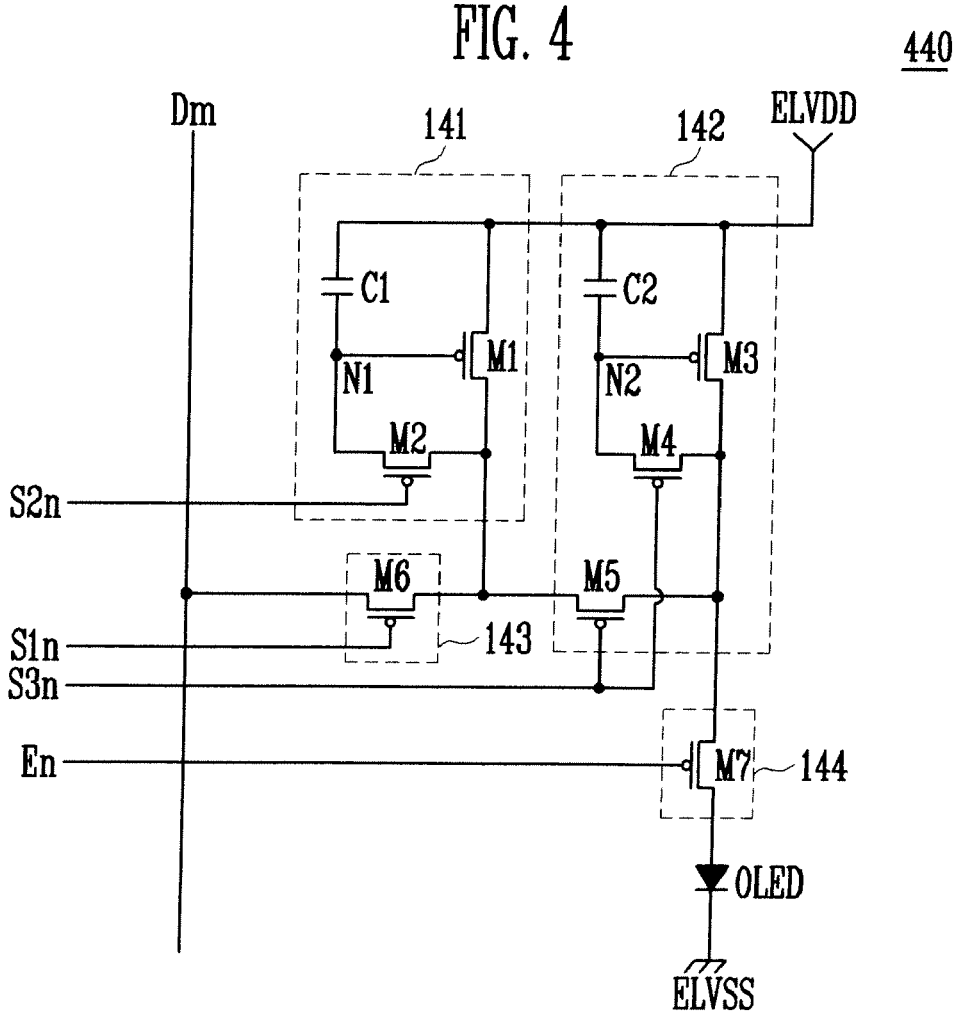
FIG. 4 is a circuit diagram showing an example of a pixel used in the organic light emitting display device shown in FIG. 2.

FIG. 4 is a circuit diagram showing an example of a pixel used in the organic light emitting display device shown in FIG. 2. FIG. 4 shows a pixel 440 coupled with the n-th scan lines S1n, S2n, S2n, and the m-th data line Dm for convenience of description.

The pixel 440 of the present invention includes an organic light emitting diode OLED, a first driver 141, a second driver 142, a first selector 143, and a second selector 144.

Different organic light emitting diodes OLED may generates red, green, or blue lights corresponding to the electric current being supplied to them. Luminance of the organic light emitting diode OLED is set to a value corresponding to a present amount of the pixel current Ioled supplied from the second driver 142.

The first driver 141 provides an electric current corresponding to the reference current Iref to the data driver 120 during the first period T1 when the second scan signal is supplied. The first driver 141 includes a first transistor M1, a second transistor M2, and a first capacitor C1.

A first electrode of the first transistor M1 is coupled with a first power supply ELVDD, and a gate electrode thereof is coupled with a first node N1. Further, a second electrode of the first transistor M1 is coupled with the first selector 143. The first transistor M1 is coupled with a data line Dm through the first selector 143 and supplies the reference current Iref to the data driver 120. On the other hand, a first electrode of each of the transistors may function as either a source electrode or a drain electrode. Then, a second electrode functions as the other of the source or drain electrodes. For example, when the first electrode functions as the source electrode, the second electrode functions as the drain electrode.

The second transistor M2 is coupled between the gate electrode and the second electrode of the first electrode M1. When the second scan signal is supplied to the second transistor M2, the second transistor M2 is turned-on to diode-connect the first transistor M1.

The first capacitor C1 is coupled between the gate electrode and the first electrode of the first transistor M1. The first capacitor C1 is charged with a voltage corresponding to the electric current Iref flowing into the second transistor M2.

The second driver 142 charges a voltage corresponding to the pixel current Ioled during the second period T2 of the horizontal period 1H when the third scan signal is supplied. Further, the second driver 142 provides the pixel current Ioled corresponding to a voltage charged after a next horizontal period to the second selector 144. The second driver 142 includes a third transistor M3, a fourth transistor M4, a fifth transistor M5, and a second capacitor C2.

A first electrode of the third transistor M3 is coupled with the first power supply ELVDD, and a gate electrode thereof is coupled with a second node N2. A second electrode of the third transistor M3 is coupled with the second selector 144. The third transistor M3 supplies the pixel current Ioled to the data driver during the second period T2 of the one horizontal period 1H. After the one horizontal period 1H, the third transistor M3 provides an electric current corresponding to a voltage charged in the second capacitor C2 to the second selector 144.

The fourth transistor M4 is coupled between the gate electrode and the second electrode of the third transistor M3. When the third scan signal is supplied to the fourth transistor M4, the fourth transistor M4 is turned-on to diode-connect the third transistor M3.

The second capacitor C2 is coupled between the gate electrode and the first electrode of the third transistor M3. The second capacitor C2 is charged to a voltage corresponding to the electric current Ioled flowing into the third transistor M3.

The fifth transistor M5 is coupled between the second electrode of the third transistor M3 and the first selector 143. When the third scan signal is supplied to the fifth transistor M5, the fifth transistor M5 is turned-on to electrically connect the second electrode of the third transistor M3 and the first selector 143 to each other.

While the first scan signal is being supplied to the first scan line S1n, the first selector 143 couples the first and second drivers 141 and 142 to the data line Dm. In order to do this, the first selector 143 includes a sixth transistor M6. A first electrode of the sixth transistor M6 is coupled with the second electrode of the first transistor M1 and the second electrode of the fifth transistor M5. A second electrode of the sixth transistor M6 is coupled with the data line Dm. When the first scan signal is supplied to the sixth transistor M6, the transistor is turned-on.

In the exemplary embodiment shown, while the emission control signal is being supplied to the emission control line En, the second selector 144 electrically isolates the organic light emitting diode OLED and the second driver 142 from each other. In contrast, while the emission control signal is not being supplied, the second selector 144 electrically connects the organic light emitting diode OLED and the second driver 142 to each other. To perform this operation, the second selector 144 includes a seventh transistor M7. A first electrode of the seventh transistor M7 is coupled with a second electrode of the third transistor M3, and a second electrode of the seventh transistor M7 is coupled with the organic light emitting diode OLED. The seventh transistor M7 is turned-off while the emission control signal is being supplied to the emission control line En.

With reference to FIGS. 3 and 4, during a horizontal period 1H, the first scan signal is supplied to the first scan line S1n. During the same period, the emission control signal is also supplied to the emission control line En. Further, during the first period T1 of the horizontal period, the scan signal is supplied to the second scan line S2n.

When the emission control signal is supplied to the emission control line En, the seventh transistor M7 is turned-off. The seventh transistor M7 maintains an off state while a voltage from the first power supply is charging various components of the pixel circuit.

When the second scan signal is provided to the second scan line S2n, the second transistor M2 is turned-on to diode-connect the first transistor M1. When the first scan signal is provided to the first scan line S1n, the sixth transistor M6 is turned-on to electrically connect the second electrode of the first transistor M1 and the data line Dm.

Accordingly, during the first period T1 of the horizontal period, the reference current Iref from the first power supply ELVDD is sunk to the data driver 120 via the first transistor M1, the sixth transistor M6, and the data line Dm. As a result, the first capacitor C1 is charged with a voltage corresponding to the reference current Iref flowing into the first transistor M1. The reference current Iref may be set to a large current value so that the capacitive load of the data line Dm may be stably charged during the first period T1.

Next, during the second period T2, the supply of the second scan signal stops to turn-off the second transistor M2. During the second period T2, the third scan signal is supplied to the third scan line S3n to turn-on the fourth transistor M4 and the fifth transistor M5. Further, during the second period, the data driver 120 sinks a sum of the reference current Iref and the pixel current Ioled.

On the other hand, during the second period T2, the second transistor M2 is turned-off. Accordingly, the first transistor M1 provides the electric current Iref corresponding to the voltage charged in the first capacitor C1 to the data driver 120.

During the second period T2, when the fourth transistor M4 is turned-on, the third transistor M3 is diode-connected. And, when the fifth transistor M5 is turned-on, a second electrode of the third transistor M3 is electrically connected with the data line Dm via the sixth transistor M6. Accordingly, the pixel current Ioled may be provided to the data driver 120 from the first power supply ELVDD, through the third transistor M3, the fifth transistor M5, the sixth transistor M6, and the data line Dm. At this time, the second capacitor C2 is charged with a voltage corresponding to the pixel current Ioled flowing into the third transistor M3.

Thereafter, after the horizontal period, the supply of the emission control signal to the emission control line En stops to turn-on the seventh transistor M7. When the seventh transistor M7 is turned-on, the pixel current Iref from the third transistor M3 is provided to the organic light emitting diode OLED corresponding to the voltage charged in the second capacitor C2. Accordingly, the organic light emitting diode OLED emits light of a luminance corresponding to the pixel current Ioled.

In the aforementioned embodiment of the present invention, during the first period of the horizontal period, the reference current Iref is sunk to first charge the capacitive loads of the data lines. During the second period, the sum of the reference current Iref and the pixel current Ioled is sunk to charge the second capacitor C2 with a voltage corresponding to the pixel current Ioled. That is, the second capacitor C2 is charged with a voltage corresponding to the pixel current Ioled, which is produced corresponding to a bit value or digital value of the data Data. The pixel current Ioled is provided to the organic light emitting diode using the charged voltage to display an image of an uniform luminance. In other words, in the embodiments of the present invention, the second capacitor C2 is charged using the pixel current Ioled. This allows a uniform image to be displayed irrespective of non-uniformity between the threshold voltage and electron mobility of different transistors.

Figure 5:
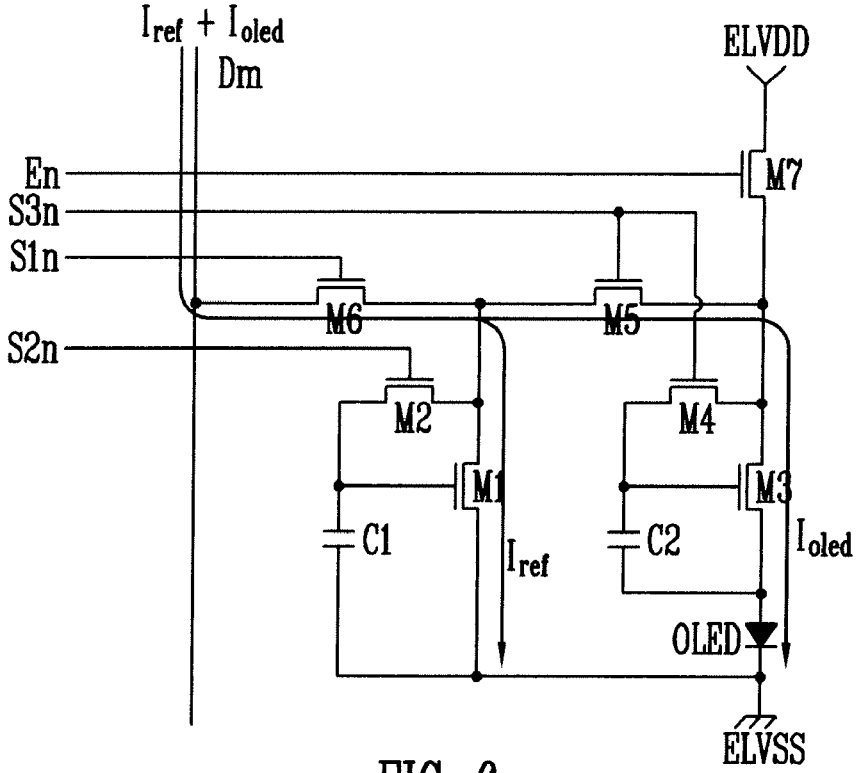
FIGS. 5 and 6 are circuit diagrams showing further examples of a pixel used in the organic light emitting display device shown in FIG. 2.
Figure 6:
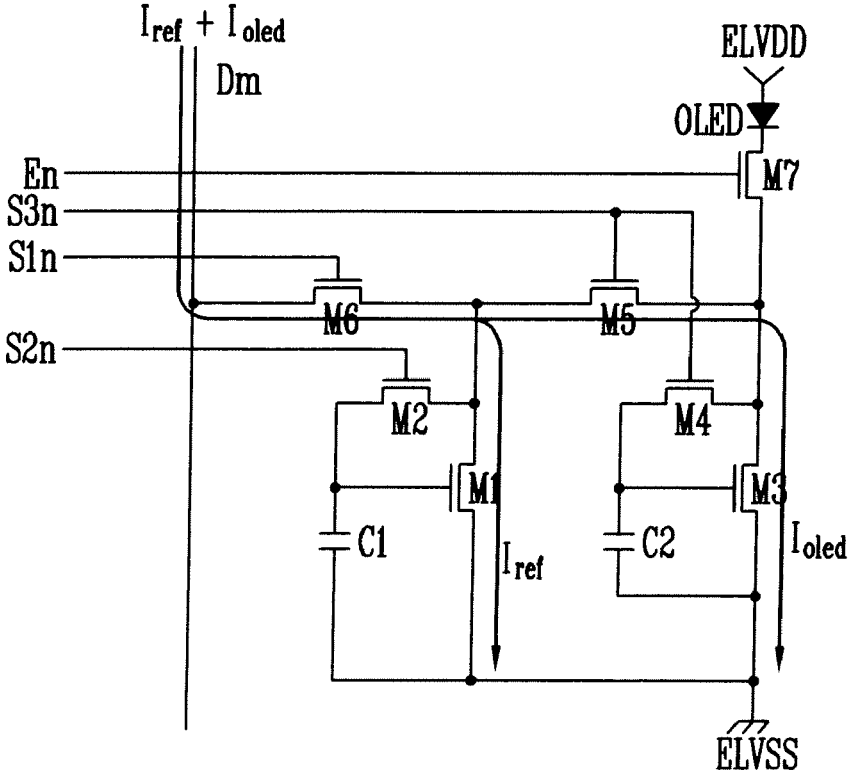

Although FIG. 4 shows one embodiment 440 of the pixel 140 as having PMOS transistors, the present invention is not so limited. As shown in FIGS. 5 and 6, other embodiments 540 and 640 of the pixel 140 can be configured with NMOS transistors. When the pixel is configured using NMOS transistors, the polarity of the waveforms shown in FIG. 3 is reversed, and an electric current is supplied to the pixel from the data driver 120. Otherwise, the driving methods are similar to the driving method of the pixel 440 shown in FIG. 4. Therefore, a detailed description of driving methods of the pixels 540 and 640 is omitted.

On the other hand, as shown in FIGS. 5 and 6, when the pixel circuit includes NMOS transistors, the organic light emitting diode OLED may be positioned either between the third transistor M3 and the second power supply ELVSS or between the first power supply ELVDD and the seventh transistor M7.

As mentioned above, according to the embodiments of the present invention, during a first period which is a first part of a horizontal period, a reference current flows to a data line to first charge the data line. During a second period, being a second part of the horizontal period, a sum of the reference current and a pixel current flows to the data line. As a result, a pixel coupled to the data line is charged with a voltage corresponding to the pixel current during the second period, and an electric current is provided to an organic light emitting diode using the charged voltage. That is, in the present invention, during the first period, the capacitive load of the data line is rapidly charged using the reference current having a relatively large current value. Further, during the second period, elements of the pixel are charged with a voltage using the pixel current. This causes an image of uniform luminance to be displayed regardless of variation between the transistors used in different pixel circuits.

Although certain exemplary embodiments of the present invention have been shown and described, it would be appreciated by those skilled in the art that changes might be made to these embodiments without departing from the principles and spirit of the invention, the scope of which is defined in the following claims and their equivalents.

What is claimed is:

1. An organic light emitting display pixel, the organic light emitting display pixel being driven during a horizontal period having a first period and a second period, the organic light emitting display pixel comprising:

an organic light emitting diode;

a first driver for developing a reference current flowing into a data line coupled to the organic light emitting display pixel, the reference current charging the data line with a first voltage during the first period;

a second driver for developing a pixel current, a sum of the reference current and the pixel current charging the data line with a second voltage during the second period;

a first selector coupled between the data line and the first driver and coupled between the data line and the second driver, the first selector being turned-on during the horizontal period for electrically connecting the data line to the first driver and the second driver; and a second selector coupled between the organic light emitting diode and the second driver, the second selector being turned-off during the horizontal period and otherwise being turned-on for electrically connecting the second driver to the organic light emitting diode.

2. The pixel of claim 1, wherein the first driver includes:

a first transistor having a first electrode coupled to a first power supply and a second electrode coupled to the first selector;

a second transistor coupled between the second electrode of the first transistor and a gate electrode of the first transistor, the second transistor being turned-on during the first period for diode-connecting the first transistor; and a first capacitor coupled between the gate electrode of the first transistor and the first electrode of the first transistor, the first capacitor being charged with a voltage corresponding to the reference current flowing into the first transistor during the first period.

3. The pixel of claim 2, wherein the first transistor is a PMOS transistor and supplies the reference current to the data line during the first period.

4. The pixel of claim 2, wherein the first transistor is an NMOS transistor and receives the reference current from the data line during the first period.

5. The pixel of claim 2, wherein the first transistor causes a current corresponding to a voltage charged in the first capacitor to flow into the data line during the second period, the current corresponding to the voltage charged in the first capacitor being substantially equivalent to the reference current.

6. The pixel of claim 2, wherein the second driver includes:

a third transistor coupled between the first power supply and the second selector, the third transistor having a first electrode coupled to the first power supply and a second electrode coupled to the second selector;

a fourth transistor coupled between a gate electrode of the third transistor and the second electrode of the third transistor, the fourth transistor being turned-on during the second period for diode-connecting the third transistor;

a second capacitor coupled between the gate electrode of the third transistor and the first electrode of the third transistor, the second capacitor being charged with a voltage corresponding to the pixel current flowing through the third transistor during the second period; and a fifth transistor coupled between the third transistor and the first selector, the fifth transistor being turned-on during the second period for electrically connecting the third transistor to the data line.

7. The pixel of claim 6, wherein the third transistor is a PMOS transistor and supplies the pixel current to the data line during the second period.

8. The pixel of claim 6, wherein the third transistor is an NMOS transistor and receives the pixel current from the data line during the second period.

9. The pixel of claim 6, wherein the first selector includes a sixth transistor being turned-on during the horizontal period, a first electrode of the sixth transistor being coupled to the fifth transistor of the second driver and the first transistor of the first driver and a second electrode of the sixth transistor being coupled to the data line.

10. The pixel of claim 9, wherein the second selector includes a seventh transistor being turned-off during the horizontal period and otherwise being turned-on, a first electrode of the seventh transistor being coupled to the third transistor of the second driver and a second electrode of the seventh transistor being coupled to the organic light emitting diode.

11. The pixel of claim 10, wherein the third transistor supplies to the organic light emitting diode a current corresponding to a voltage charged in the second capacitor when the seventh transistor is turned-on, the current corresponding to the voltage charged in the second capacitor being substantially equivalent to the pixel current.

12. The pixel of claim 1, wherein the reference current is set to be greater than the pixel current.

13. The pixel of claim 1, wherein the pixel current is an electric current supplied to the organic light emitting diode, the pixel current corresponding to data being supplied to the data line as data signals.

14. An organic light emitting display device comprising:

a plurality of pixels;

first scan lines, second scan lines, third scan lines, emission control lines, and data lines coupled to the plurality of pixels;

a scan driver coupled to the first scan lines, the second scan lines, the third scan lines, and the emission control lines, the scan driver driving the first scan lines, the second scan lines, the third scan lines, and the emission control lines; and a data driver coupled to the data lines, the data driver causing a reference current to flow in the data lines during a first period of a horizontal period and causing a sum of the reference current and a pixel current to flow in the data lines during a second period of the horizontal period.

15. The organic light emitting display device of claim 14, wherein the plurality of pixels include circuits configured using PMOS transistors, and wherein the data driver sinks an electric current from the plurality of pixels during the horizontal period.

16. The organic light emitting display device of claim 14, wherein the plurality of pixels include circuits configured using NMOS transistors, and wherein the data driver supplies an electric current to the plurality of pixels during the horizontal period.

17. The organic light emitting display device of claim 14, wherein a first scan signal is sequentially supplied to the first scan lines every horizontal period, wherein a second scan signal is sequentially supplied to the second scan lines every first period of the horizontal period, and wherein a third scan signal is sequentially supplied to the third scan lines every second period of the horizontal period.

18. The organic light emitting display device of claim 17, wherein an emission control signal is sequentially applied to the emission control lines every horizontal period, the emission control signal having a duration equal to or greater than a duration of the first scan signal.

19. The organic light emitting display device of claim 18, wherein the pixel current is produced corresponding to data received by the data driver, and wherein the reference current has a fixed electric current value greater than a value of the pixel current.

20. The organic light emitting display device of claim 19, wherein each of the plurality of pixels includes:

an organic light emitting diode;

a first driver for developing the reference current flowing into a data line coupled to the pixel from among the data lines, the reference current charging the data line with a first voltage during the first period;

a second driver for developing the pixel current, a sum of the reference current and the pixel current charging the data line with a second voltage during the second period;

a first selector coupled between the data line and the first driver and coupled between the data line and the second driver, the first selector being turned-on during the horizontal period for electrically connecting the data line to the first driver and the second driver; and a second selector coupled between the organic light emitting diode and the second driver, wherein the second selector electrically isolates the organic light emitting diode from the second driver responsive to the emission control signal being supplied to the second selector, and wherein the second selector electrically connects the organic light emitting diode to the second driver responsive to the emission control signal not being supplied to the second selector.

21. The organic light emitting display device of claim 20, wherein the first driver includes:

a first transistor having a first electrode coupled to a first power supply and a second electrode coupled to the first selector;

a second transistor coupled between the second electrode of the first transistor and a gate electrode of the first transistor, the second transistor for diode-connecting the first transistor by being turned on responsive to the second scan signal; and a first capacitor coupled between the gate electrode of the first transistor and the first electrode of the first transistor, the first capacitor being charged with a voltage corresponding to the reference current flowing into the first transistor during the first period.

22. The organic light emitting display device of claim 21, wherein the second driver includes:

a third transistor having a first electrode coupled to the first power supply and a second electrode coupled to the second selector;

a fourth transistor coupled between a gate electrode of the third transistor and the second electrode of the third transistor, the fourth transistor for diode-connecting the third transistor while being turned-on responsive to the third scan signal;

a second capacitor coupled between the gate electrode of the third transistor and the first electrode of the third transistor, the second capacitor being charged with a voltage corresponding to the pixel current flowing through the third transistor during the second period; and a fifth transistor coupled between the third transistor and the first selector, the fifth transistor being turned-on responsive to the third scan signal.

23. The organic light emitting display device of claim 22, wherein the first selector includes a sixth transistor being turned-on responsive to the first scan signal, the sixth transistor having a first electrode coupled to the first driver and the second driver and a second electrode coupled to the data line.

24. The organic light emitting display device of claim 23, wherein the second selector includes a seventh transistor being turned-off responsive to the emission control signal being supplied and being turned-on responsive to the emission control signal not being supplied, the seventh transistor being coupled between the second driver and the organic light emitting diode.

25. A method for driving an organic light emitting display device having data lines and a plurality of pixels, each of the plurality of pixels including a first driver, a second driver and an organic light emitting diode, and each of the plurality of the pixels being coupled to a corresponding one of the data lines, the method comprising:

controlling a reference current to flow into the data lines during a first period of a first horizontal period;

charging the first driver during the first period of the first horizontal period with a voltage corresponding to the reference current;

controlling a sum of the reference current and a pixel current to flow into the data lines during a second period of the first horizontal period;

charging the second driver during the second period of the first horizontal period with a voltage corresponding to the pixel current; and supplying the pixel current to the organic light emitting diode from the second driver during a horizontal period following the first horizontal period to cause the organic light emitting diode to emit light.

26. The method of claim 25, wherein the reference current is greater than the pixel current.

27. The method of claim 25, wherein the pixel current is produced corresponding to a digital value of data provided to a data driver coupled to the data lines.

* * * * *